United States Patent [19]

Folland

[11] 4,291,720

[45] Sep. 29, 1981

[54] PRESSURE CONTROLLED RECEIVER FOR STORING EMULSION

[75] Inventor: Roy E. Folland, Clarenceville, Canada

[73] Assignee: Folland Corporation, Dade County, Fla.

[21] Appl. No.: 25,865

[22] Filed: Apr. 2, 1979

[51] Int. Cl.[3] ..... B65D 83/14

[52] U.S. Cl. ..... 137/209; 137/423

[58] Field of Search ..... 137/209, 394, 423, 206

[56] References Cited

U.S. PATENT DOCUMENTS 1,720,919 7/1929 Nesbitt ..... 137/423 X 2,588,677 3/1952 Welty ..... 137/391 X 3,841,710 10/1974 Boland ..... 137/13 X

*Primary Examiner*—Alan Cohan

*Attorney, Agent, or Firm*—Alan Swabey; Robert Mitchell; Guy J. Houle

[57] ABSTRACT

A pressure controlled emulsion storage receiver for use in an emulsifying system. The receiver comprises an inlet for receiving emulsion, and an outlet for delivering pressurized emulsion from the receiver. A fluid inlet is provided for feeding into the receiver pressurized fluid from a source. A level control is also provided to maintain a quantity of emulsion in the receiver between predetermined limits. The arrangement also provides for the maintenance of a predetermined fluid pressure in the receiver.

1 Claim, 2 Drawing Figures

PRESSURE CONTROLLED RECEIVER FOR STORING EMULSION

BACKGROUND OF INVENTION (a) Field of the Invention

The present invention relates to improvements in an emulsion storage receiver for use in an emulsifying system, and particularly, but not exclusively, to a receiver for the storage of an emulsion of water and oil.

(b) Description of Prior Art

In my U.S. Pat. No. 4,117,550 issued on Sept. 26, 1978, there is described an emulsifying system for mixing accurate ratios of water and oil to form an emulsion and to store it in a receiver where the emulsion is completely regenerated through a feedback loop. The present invention is concerned with an improved container or receiver construction for use, for example, in such systems where a quantity of emulsion is required to be maintained between predetermined limits in a container to feed burner devices, or the like equipment.

There exists the need to provide receivers wherein emulsion stored therein will be maintained under pressure and wherein a volume of emulsion can be suitably maintained between predetermined limits. Further, there exists the need to provide a receiver which can feed heated emulsion to devices, such as pumps, as used in an emulsion system of the type as in my aforementioned U.S. patent, without vapourizing and gasifying of the fuel oil emulsion as it enters such pump from the container. This vapourization problem arises when heated emulsion is placed into a receiver that is vented to atmosphere and then drawn out of the receiver. This causes the pressure of the emulsion to drop too low resulting in gasifying or vapourizing and the downstream equipment being fed by the receiver then receives vapour as well as emulsion.

SUMMARY OF INVENTION

It is a feature of the present invention to provide an emulsion storage receiver which is pressurized and which will automatically maintain a volume of emulsion therein, between predetermined limits.

It is a further feature of the present invention to provide a pressure controlled emulsion storage receiver for receiving a heated fuel oil emulsion and which substantially eliminates vapourizing or gasifying of the emulsion.

It is a further feature of the present invention to provide a pressure controlled emulsion storage receiver for heated fuel oil emulsion and maintaining the emulsion in the receiver at a predetermined pressure, which pressure may vary according to the temperature of the emulsion.

A still further feature of the present invention is to provide a pressure controlled emulsion storage receiver wherein a variable volume chamber is associated with the receiver to maintain the emulsion therein under pressure and wherein pressure sensing means automatically controls the level of emulsion in the receiver between predetermined limits.

According to the above features, from a broad aspect, the present invention provides a pressure controlled emulsion storage receiver for use in an emulsifying system. The receiver comprises an inlet for receiving an emulsion, and an outlet for delivering pressurized emulsion from the receiver. A fluid inlet is provided for feeding into the receiver pressurized fluid from a source. Level control means is also provided to maintain a quantity of emulsion in the receiver between predetermined limits. Means is also provided to maintain a predetermined fluid pressure in the receiver to prevent the emulsion from vapourizing.

According to a further broad feature of the present invention, there is provided a pressure controlled emulsion storage receiver for use in an emulsifying system. The receiver comprises an inlet for receiving an emulsion, and an outlet for delivering pressurized emulsion from the receiver. A variable volume chamber is associated with the receiver. The variable volume chamber has a predetermined charge of compressed gas therein. The variable volume is altered by the volume of the emulsion in the receiver. Level control means is also provided to maintain a quantity of emulsion between predetermined limits in the receiver.

BRIEF DESCRIPTION OF DRAWINGS

A preferred embodiment of the present invention will now be described with reference to the examples thereof as illustrated in the accompanying drawings in which.

DESCRIPTION OF PREFERRED EMBODIMENTS

Figure 1:
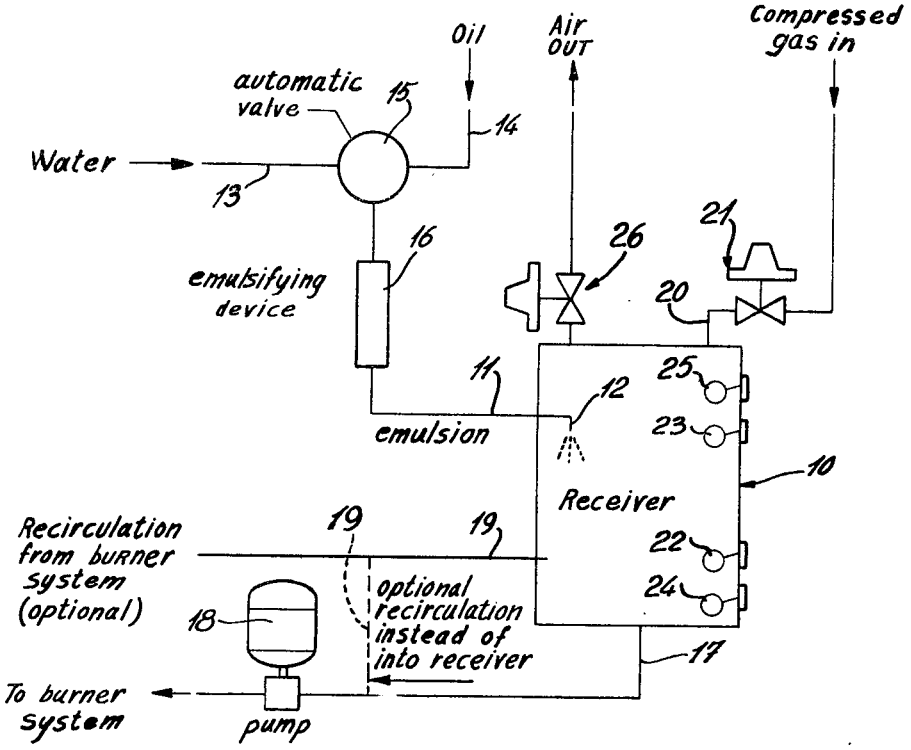
FIG. 1 is a schematic diagram of a pressure controlled emulsion storage receiver of the invention.

Referring now to the drawings, and more particularly to FIG. 1, there is shown the pressure controlled emulsion storage receiver 10 having an inlet supply line 11 feeding an inlet 12 located within the receiver 10 whereby to feed an emulsion therein. In this particular embodiment, the emulsion consists of a mixture of water and oil from supply lines 13 and 14 feeding an automatic valve 15 which in turn feeds an emulsifying device 16, such valve and emulsifying device being well known in the art.

An outlet 17 is provided in the receiver 10 to deliver pressurized emulsion from the receiver to either a delivery pump 18 which in turn feeds a burner system (not shown), or directly to a burner system. A recirculation feedback loop 19 may be provided at the outlet of the receiver 10 to regenerate the emulsion.

Compressed gas, from a source of compressed gas, such as compressed air, (not shown) is fed into the receiver 10 through a fluid inlet 20 via a pressure regulated valve 21. The pressure regulated valve 21 constitutes a means to maintain a predetermined fluid pressure in the receiver to prevent heated emulsion from vapourizing. The heated emulsion is at a temperature of at least 120° F. The pressure within the receiver 10 may be varied depending on the temperature of the emulsion in the receiver and this variation is provided by the pressure regulated valve which will sense the change in pressure within the receiver.

Level control means is provided within the receiver to maintain predetermined levels of emulsion in the receiver. As hereinshown, the level control means is constituted by a low and high level sensor in the form of float controls 22 and 23, respectively. Further, an overriding float control 24 is provided for the low level float control 22 an an overriding float control 25 is provided for the high level float control 23. These overriding float controls will cut off the delivery of emulsion to the inlet 12 should the low and high level float controls 22 and 23 malfunction. When the level of emulsion rises from the level of the lower level float control 22 to the high level float control 23, the pressure release valve 26 will automatically open to allow gas within the receiver to vent. This valve 26 will allow the required amount of gas to escape in order to maintain a predetermined pressure in the receiver.

In operation, as the emulsion enters the receiver 10 via the inlet 12, the level of emulsion in the receiver will rise until the high level is reached and then the automatic valve 15 will be shut off by a signal received from the high level float control 23. The pump 18 will then draw emulsion out of the receiver 10 until the level of the emulsion therein reaches the low level which is determined by the low level float control 22. This will automatically cause the automatic valve 15 to open. While the level of emulsion in the receiver is dropping from the high to the low level, compressed gas enters the receiver through the pressure regulating valve 21 which is set to provide gas, herein air, at the required flow so as to maintain a predetermined pressure in the receiver. Thus, the heated emulsion within the receiver is always maintained at a predetermined pressure which prevents vapourizing or gasifying of the fuel oil emulsion supplied thereto.

Figure 2:
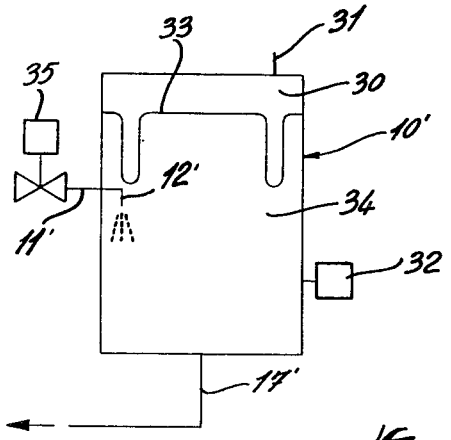
FIG. 2 is a schematic diagram showing an improvement of the pressure controlled emulsion storage receiver.

Referring now to FIG. 2, there is shown a further embodiment of the receiver 10. The embodiment of FIG. 2 is herein designated by reference numeral 10'. The pressure controlled receiver 10' is also fed emulsion from an inlet supply line 11' and emulsion is withdrawn from the outlet 17'. In this receiver 10', there is provided a variable volume chamber 30 which is fed a predetermined charge of compressed gas by suitable means such as the fluid inlet 31. The variable volume chamber 30 is altered by the volume of the emulsion in the receiver. Also, the levels of emulsion within the receiver are controlled by a level control pressure switch 32.

The variable volume chamber 30 is defined by an expandable diaphragm 33 which is sealingly secured within the receiver to divide it into an emulsion receiving chamber 34 and the variable volume chamber 30.

The pressure in the variable volume chamber 30 pressurizes the emulsion in the emulsion chamber 34.

The level control pressure switch 32 senses the pressure inside the emulsion receiving chamber 34. As the emulsion within the chamber 34 leaves the receiver through outlet 17', the pressure will drop below a predetermined low pressure setting of the pressure switch 32 and this will cause the automatic valve 35 connected in the inlet supply line 11' to open, thereby allowing emulsion to enter the chamber 34 via inlet 12'. As the emulsion enters into this chamber 34 and the level thereof rises, the gas in variable volume chamber 30 will compress as the volume of emulsion increases. As the gas in the variable volume chamber 30 is compressed, the pressure in both chambers 34 and 30 will increase. When the pressure within chamber 34 reaches a predetermined high pressure setting of the pressure switch 32, the pressure switch 32 will send a signal to the inlet valve 35 to close and shut off the supply of emulsion. Thus, there is provided the level control means for the receiver to maintain the emulsion between predetermined limits.

Although the diaphragm 33 is shown as separating the container 10' into separate chambers 30 and 34, it is possible to use a completely separate unit (not shown) with such a diaphragm therein. The separate unit would be arranged so that the chamber 34 is connected to it and provides the variable volume chamber necessary to maintain the necessary pressure to the emulsion to provide automatic operation. Of course, the receiver of FIG. 2 may be used to store any type of liquid that requires to be pressurized and maintained between predetermined limits.

It is within the ambit of the present invention to provide any obvious modifications of the examples described herein, provided these modifications fall within the scope of the claims appended hereto.

I claim:

1. A pressure controlled emulsion storage receiver for use in an emulsifying system, said receiver comprising an inlet for receiving an emulsion, an outlet for delivering pressurized emulsion from said receiver, a compressed gas inlet for feeding into said receiver pressurized gas from a source, level control means to maintain a level of emulsion between predetermined limits in said receiver, and means to maintain a predetermined gas pressure in the area of said receiver above the emulsion therein whereby said emulsion is maintained at a substantially constant pressure which is the same as the gas pressure in said receiver to prevent said emulsion from vaporizing, said level control means comprising a low and a high level sensor of the float control type in said receiver to sense a predetermined low and high level of emulsion in said receiver, and an overriding float control for each of said low and high level sensors whereby to cut-off delivery of emulsion at said inlet in the event the emulsion level within said receiver goes beyond said predetermined low and high levels of emulsion.

* * * * *